United States Patent [19]

Engelbert

[11] 3,938,935

[45] Feb. 17, 1976

[54] CONTROL SYSTEMS FOR GASEOUS FUEL FIRED APPLIANCES

[75] Inventor: Harald Engelbert, London, England

[73] Assignee: Radiation Limited, London, England

[22] Filed: Nov. 19, 1973

[21] Appl. No.: 417,284

[30] Foreign Application Priority Data

Nov. 17, 1972 United Kingdom ..... 53239/72

[52] U.S. Cl. ..... 431/47; 431/54; 431/255; 137/630.14; 137/630.15; 251/234; 236/1 H

[51] Int. Cl.[2] ..... F23Q 9/08

[58] Field of Search ..... 236/1 H, 1 E, 15 A, 99 G; 137/66, 599.2, 629, 630 14, 630.15; 431/43, 47, 53, 54, 255; 251/234

[56] References Cited

UNITED STATES PATENTS

| | | | |
|---|---|---|---|
| 393,020 | 11/1888 | McLaren | 251/234 |
| 1,696,143 | 12/1928 | Hinchman | 137/494 |
| 2,191,078 | 2/1940 | Kehl | 239/414 |
| 2,355,043 | 8/1944 | Adlam | 236/91 |
| 3,190,314 | 6/1965 | Visos et al. | 137/630.15 |
| 3,275,035 | 9/1966 | Freeby et al. | 137/630.15 |
| 3,314,448 | 4/1967 | Wolff et al. | 137/629 |
| 3,508,567 | 4/1970 | Kirk et al. | 251/234 |

*Primary Examiner*—Carroll B. Dority, Jr.
*Attorney, Agent, or Firm*—Brisebois & Kruger

[57] ABSTRACT

A control unit for a gas-fired appliance comprises a service tap that acts also as a flame failure device. The flame failure device controls gas flow to a gas governor which is an integral part of the unit and associated with the gas governor is a low gas pressure cut-off. The unit also incorporates a modulating gas flow control valve operatively coupled to a thermostat which, in the case of a gas-fired water heater, is responsive to water temperature in the heater. When used with a water heater, the unit also includes a further thermostat set to terminate gas flow in the event that a predetermined maximum water temperature is exceeded.

17 Claims, 11 Drawing Figures

CONTROL SYSTEMS FOR GASEOUS FUEL FIRED APPLIANCES

This invention relates to control systems for gaseous fuel-fired appliances and has particular although not exclusive reference to control systems for gas-fired water heaters which term includes the so-called central heating boilers.

According to the present invention, a control system for a gaseous fuel-fired appliance includes a gaseous fuel flow control valve having a first flow control member for controlling fuel flow from an inlet to an outlet, a movable member, a linkage interconnecting the movable member and the first control member in such manner that movement of the movable member produces movement of the first control member, means for varying the ratio of movement of the movable member to movement of the first control member and an arrangement for moving the flow control valve between a first position permitting fuel flow from the inlet to the outlet and a second position preventing said flow.

The system may also include a passage interconnecting the inlet and outlet, a second flow control member for controlling fuel flow along the passage, and further means for adjusting the effective cross-sectional area of the passage or a portion thereof to control the maximum rate of flow of fuel along the passage.

The linkage may comprise a pivotally mounted lever operatively interconnecting the movable member and the first flow control member, means being provided for moving the pivot point of the lever along the length of the latter.

The first flow control member may comprise a valve member and a co-operating valve member seating, fuel flow from the inlet to the outlet being stopped when the valve member seats on the seating. Preferably, the lever is resiliently connected to the valve member in such manner that any pivotal movement of the lever that takes place after the valve member is seated on the seating in a direction urging the member towards the seating takes place against the resilient connection.

In one embodiment of the invention, the passage passes through the first flow control member and the further means is mounted upon the latter.

The valve member may comprise a tubular extension which forms the passage. In that event, the further means may comprise a tube movement of which relative to the tubular extension varies maximum rate of flow of fuel through the passage.

The tube may be open at one end and closed at the other, and may have, adjacent the closed end, a slot which extends round part of the periphery of the tube. The slot may be obturated to a greater or lesser extent by axial movement of the tube relatively to the tubular extension.

The arrangement for moving the flow control valve may be an electromagnet whose armature is operatively connected to the closed end of the tube. Movement of the flow control valve by the electromagnet involves movement of both first and second flow control members.

The movable member may form part of a thermally responsive device.

Alternatively, the present invention envisages, for a gaseous fuel-fired appliance, a control system including a fuel flow control valve, a valve operating member for operating the valve against the action of restoring means, a mechanism for holding the member in an operated position against the action of the restoring means, and means for disabling the mechanism.

The mechanism may comprise an "over-centre" linkage with first and second levers of which one is pivotally mounted upon the operating member and is resiliently biassed into engagement with the other lever.

The levers may have co-operating surfaces comprising a recess or socket on one lever for receiving the rounded end of the other lever.

The disabling means may comprise an electromagnet whose armature is spring biased into operative engagement with one of said levers to prevent the mechanism linkage passing over-centre to hold the member in the operated position. The arrangement is such that when the electromagnet is energised and the armature held in an attracted position thereby, the armature is held out of operative engagement with the lever.

A second disabling means may be provided and may comprise a further pivoted lever.

The further pivoted lever is arranged to move the linkage from the over-centre position when the second means is required to disable the mechanism.

The fuel flow control valve may constitute a flame failure valve in which case the electromagnet is joined to means responsive to the presence of a flame, the responsive means effecting de-energisation of the electromagnet when the flame is absent.

The invention also envisages a control system incorporating a first gaseous fuel flow control valve having first flow control member for controlling fuel flow from an inlet to an outlet, a thermally responsive device including a movable member, a linkage interconnecting the movable member and the first control member in such manner that movement of the movable member produces movement of the first control member, means for varying the ratio of movement of the movable member to movement of the first control member, an arrangement for moving the flow control valve between a position permitting fuel flow from the inlet to the outlet and a second position preventing said flow, a further fuel flow control valve in series connection, with respect to said fuel flow, with the first flow control valve, a valve operating member for operating the valve against the action of restoring means to a position in which fuel flow is permitted from the inlet to the outlet, a mechanism for holding the member in an operated position, means for disabling the mechanism and a single manually-operable control controlling the arrangement and the valve operating member.

The components referred to in the immediately preceding paragraph may take one or other of the forms mentioned above.

The single control may also operate or control the operation of other components found in control systems, for example, a valve controlling the flow of fuel to a pilot burner, an ignitor device for igniting fuel issuing from the pilot burner, and a thermostat.

By way of example only, an embodiment of the invention will now be described in greater detail with reference to the accompanying drawings in which.

Figure 1:
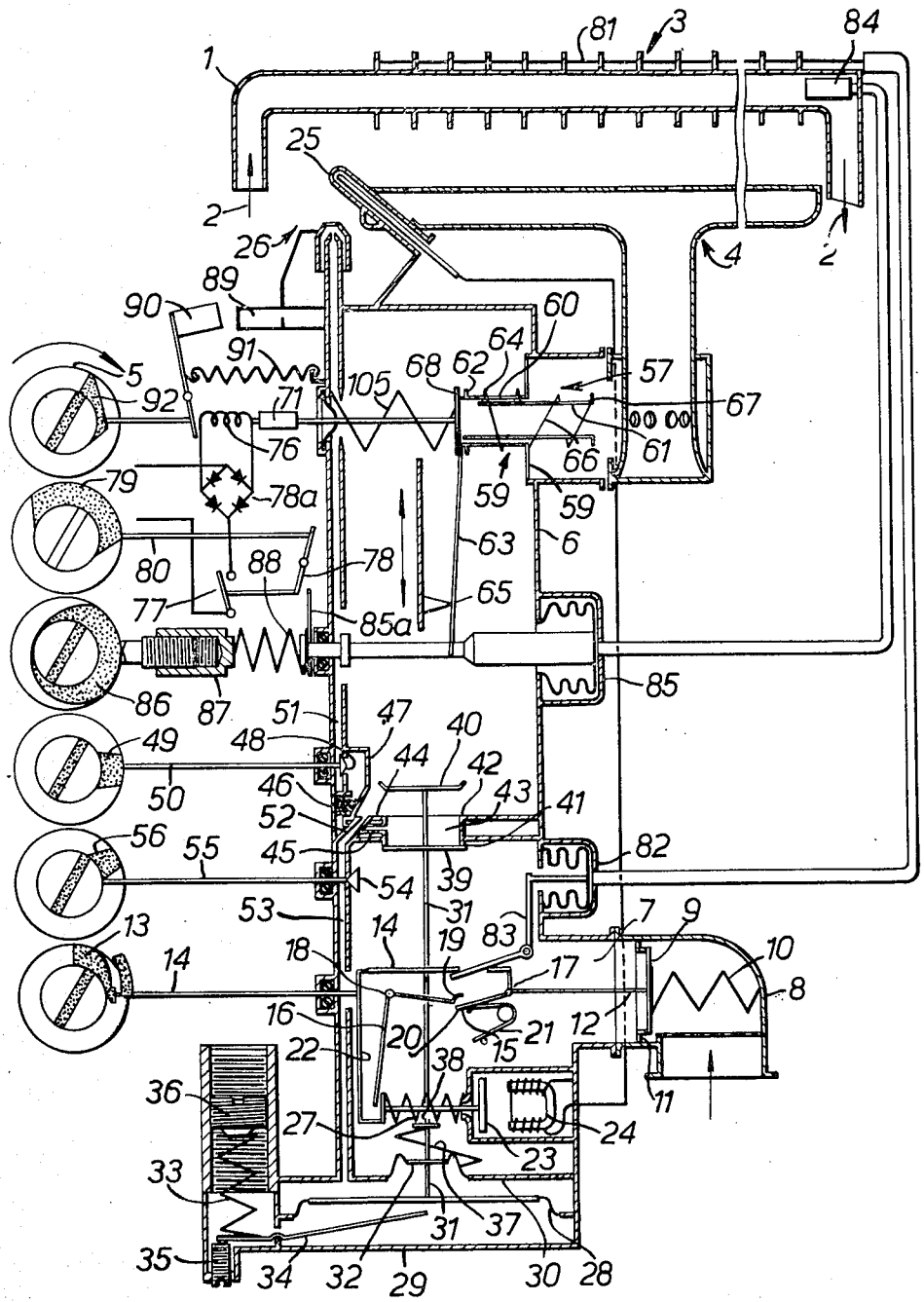
FIGS. 1–8 show the embodiment in diagrammatic form only different drawings showing parts in different working positions, and, FIGS. 9 and 10 show in diagrammatic form parts of the embodiment on an enlarged scale.

The embodiment comprises a control unit for a gas-fired central heating boiler and the drawings show only those parts of the boiler necessary for an understanding of the present invention. Whilst the great majority of reference numerals have been inserted in FIG. 1, FIGS. 2–8 bear only those reference numerals required by the description of the Figure.

FIG. 1 shows a water path 1 along which water to be heated flows in the direction of arrows 2. Part of the path is constituted by a heat exchanger 3 located above a gas burner 4. The gas burner and heat exchanger may be of a construction described in more detail in the specification of co-pending U.S. patent application No. 350,780.

The control system provides in a single unit all the control facilities that are required. Manual control is effected via a single control knob 5 carrying a plurality of control cam surfaces which, with their associated control rods, are shown separately in the drawings.

Figure 9:
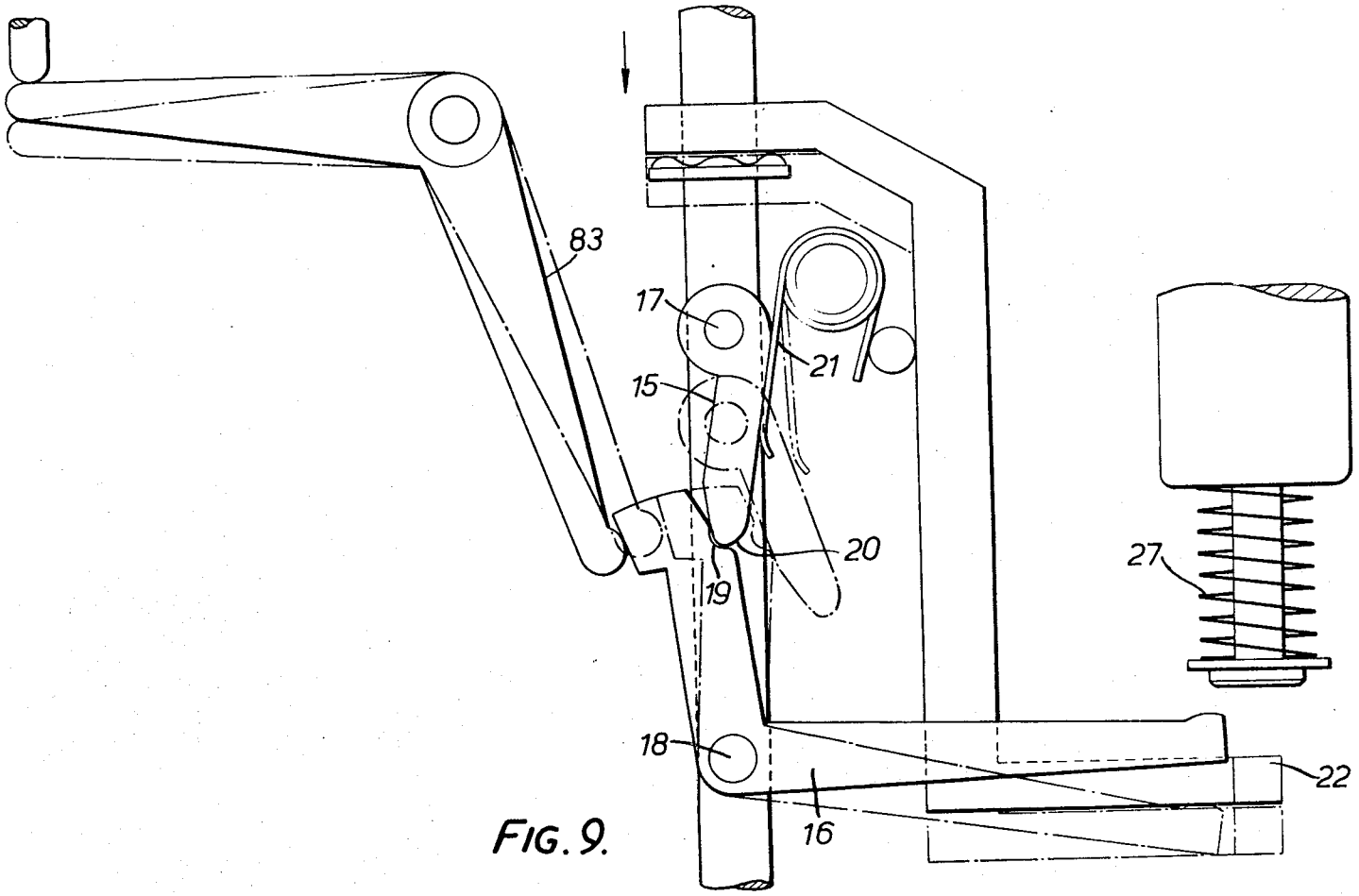

The system is shown as being housed in a casing 6 with a gas inlet 7 releasably joined to an elbow 8 forming part of a gas supply conduit (not shown). The elbow 8 houses a gas shut-off valve 9 urged by spring 10 into contact with a seating 11. Movement of the valve 9 away from the seating 11 is effected by a push-rod 12 in contact with but not fixed to valve 9 and operable, in a manner to be described later, by a first cam surface through a push-rod 14. Associated with the push-rods 12, 14 is a pair of levers 15, 16 pivotally mounted at points 17 and 18 respectively. The levers 15, 16 form part of a locking mechanism for holding the valve 9 off its seating 11 in circumstances described below. Lever 16 is a double-armed lever one of the arms being formed with a recessed surface 19 adapted to co-operate with the rounded end 20 of lever 15. The lever 15 is pivotally mounted on push-rod 14 although, for purposes of clarity not so shown in FIGS. 1–8 but FIG. 9 reveals the actual detail. Lever 15 is biassed to move in a clockwise direction about its pivot point 17 by a spring 21.

Push-rod 14 has an extension 22 adjacent to the armature 23 of an electromagnet 24 whose operating coil is energised from a thermocouple located in a housing 25 positioned to be exposed to the heat of the flame of a pilot burner 26. Armature 23 is biassed away from the electromagnet 24 by a spring 27.

Housed at the lower (as seen in FIGS. 1–8) end of the casing 6 is a flexible diaphragm 28 which divides into two parts, a compartment formed by an end wall 29 of the casing 6 and an adjacent inner wall 30. The inner wall 30 is apertured to permit passage of an operating rod 31 fixed to the diaphragm 28, the aperture being sealed by a secondary flexible diaphragm 32 secured to the rod 31. Under certain conditions, diaphragm 28 is spring loaded in an upward direction (as seen in FIGS. 1–8) by a spring 33 acting through a lever 34 pivoted on the end wall 29. Pivotal movement of the lever in an anti-clockwise direction is limited by a screw adjuster 35. The spring 33 is housed adjacent the diaphragm as shown and in the housing is a screw adjuster 36 for varying the loading on the diaphragm. Diaphragm 28 is also loaded by a second spring 37 much weaker than spring 33 and which acts in the same direction as the latter between a stop 38 on rod 31 and the inner wall 30. The arrangement permits adjustment of the spring loading from opposite sides. In addition, there is a washer (not shown) interposed between screw adjustor 36 and the spring 33 so that rotation of the screw adjustor 36 to vary the loading exerted by the spring 33 is not transferred to the latter causing it to be twisted and thereby change the loading.

Operating rod 31 carries two valves 39, 40 which co-operate respectively with seatings 41, 42 formed on opposite sides of an aperture 43 in an internal wall 44 in the casing 6. The wall of the aperture 43 is formed between the seatings 41, 42 with a transverse passageway 45 which communicates via a filter 46 with a chamber 47 with an outlet controlled by a pilot burner valve 48 operated by a further cam surface 49 via a connecting rod 50. Valve 48 controls gas flow from chamber 47 to a conduit 51 leading to the pilot burner 26. The conduit 51 is shown as being inside the casing 6 but it may be external if required. For the sake of clarity, the conduit 51 is shown broken at various points to permit other components to be shown but it will be understood that the conduit is, in fact, unbroken.

The internal wall 44 has a further passageway 52 providing communication between the downstream side of the wall and a further conduit 53 leading to the chamber lying between the diaphragm 28 and the inner wall 30. Communication between the upstream side of internal wall 44 and conduit 53 is controlled by a valve 54 operable via operating rod 55 by a further cam surface 56. The conduit 53 is shown broken at one point but is, in fact, continuous.

Figure 10:
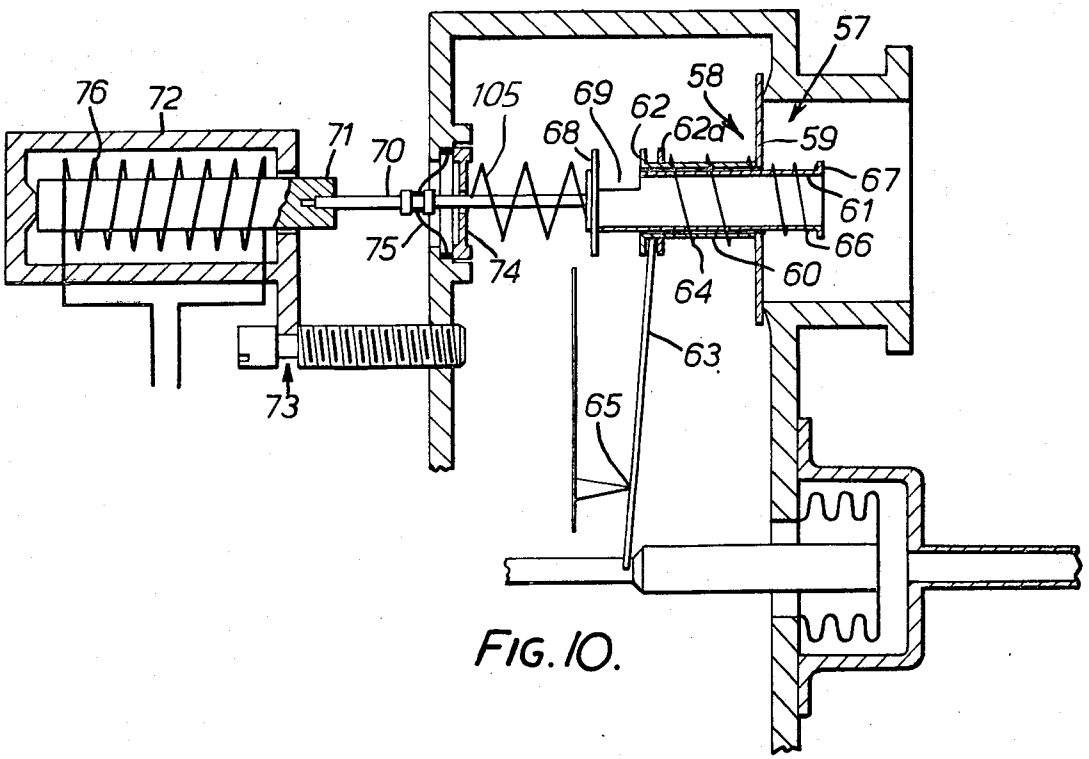

Gas flow from the interior of casing 6 downstream of internal wall 44 to the gas burner 4 is controlled by a modulating gas valve 57 shown diagrammatically in FIGS. 1–8 and in more detail in FIG. 10. The gas valve 57 is in two parts, a main valve 58 comprising a disc 59 and a central tubular extension 60 in which a second mainly tubular portion 61 is slidably mounted. The tubular extension 60 has an outwardly extending flange 62 at one end against one end of a lever 63 is urged into contact by a spring 64 encircling the extension 60. Spring 64 acts between disc 59 and a washer **62*a* loose on extension 60. The lever 63 is pivoted about a pivot point 65 whose position along the length of the lever is adjustable by any suitable means not shown in the drawings. A part of the tubular portion 61 of the main valve 58 carries a spring 66 located between disc 59 and a flange 67 at one end of the portion 61. The portion 61 is closed at its other end by an end wall 68 adjacent which the portion 61 has a peripheral slot 69. Secured to the end wall 68 is an operating rod 70 which passes through the wall of the casing 6 and is secured externally of the latter to the armature 71 of an electromagnet located in a housing 72 movable, with armature 71, towards and away from casing 6 by means of a screw adjuster 73. Longitudinal movement of the rod 70 is guided by support 74 mounted in the wall of the casing 6 whilst leakage of gas in this area is prevented by a flexible diaphragm 75 extending from the rod 70 to the casing wall as seen in FIG. 10**.

Energisation of the coil 76 of the electromagnet located in the housing 72 is controlled by a microswitch 77 which, when operated completes an input circuit from the supply mains to a full-wave rectifier **78*a* which d.c. output points are connected across coil 76. Microswitch 77 is operated by a pivoted lever 78 movement of which is effected from a further cam 79 on the control knob 5 via a connecting rod 80**.

The heater incorporates thermostatic control by thermally responsive elements and one of these 81 is mounted in the heat exchanger 3 externally of the water path 1. The thermostats are of the phial and bellows type and phial 81 is joined to a bellows unit 82 in the control unit and operates a release lever 83 associated with locking mechanism described above.

The second thermostat has its phial 84 mounted in the water path 1 and is joined to a bellows unit 85 operatively connected to lever 63. Bellows unit 85 has a manual control which allows presetting of the operating temperature of the thermostat. The manual control is provided by a further cam 86 on the control knob 5, the cam 86 acting through an adjuster 87 and a spring 88. Phial and bellows unit 84, 85 is also able to actuate the microswitch 77 in suitable circumstances through the medium of an actuating member 85*a*.

The control unit also incorporates an ignition device for igniting, at the appropriate moment, gas issuing from the pilot burner 26. The ignition device embodies a piezo-electric crystal indicating in FIGS. 1–8 as block 89 and a mechanical device for applying mechanical stress to the crystal. The mechanical device is shown in FIGS. 1–8 as a pivotal "hammer" 90 loaded by a spring 91 and operated by yet another cam 92 on the control knob 5. The representation of the ignition device is purely diagrammatic, the device itself may take any one of many well known forms.

Figure 11:
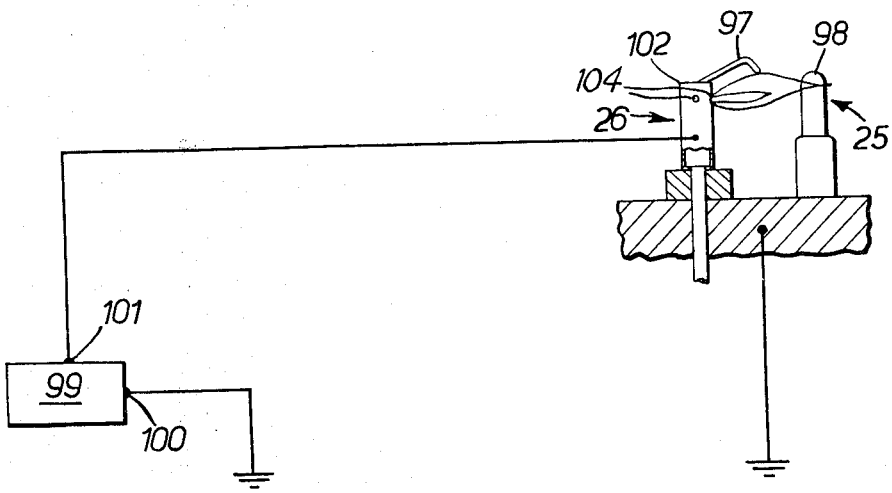
FIG. 11 shows a piezo-electric generator connected to the housing of a pilot burner used in carrying out the invention.

The e.m.f. produced by the piezo-electric crystal is applied to an ignition electrode adjacent the pilot burner as shown in FIG. 1 or as shown in more detail in FIG. 11.

As shown in FIG. 11, a piezo-electric generator 99 has output terminals 100, 101 of which the former is earthed and the latter connected to the tubular metal housing 102 of the pilot burner 26 mounted upon an earthed structure 103. The housing 102 is closed at its upper end but has flame orifices 104 formed in its cylindrical wall. One of the orifices faces the thermocouple housing 25 while another faces the burner 4 and is the orifice for an ignition flame for that burner. Secured to the upper end of the housing 102 is a length of wire which forms an ignition electrode and, with the housing 25 defines a spark gap into which gas from an adjacent orifice is directed.

It will be appreciated that the housing 102 need not be of metal and that a construction using non-electrically conductive material could be used. For example the housing 102 could be wholly or partly of ceramic and in this case the terminal 101 is connected directly to the ignition electrode 97 or to an electrically conductive strip on the housing 102, the strip being electrically connected to the electrode 97.

Alternatively, the pilot burner housing itself may constitute the ignition electrode or may have an integral part that forms the ignition electrode.

The termocouple shown in FIGS. 1–8 generates e.m.f. to energise the electromagnet 24 referred to above. Further details of the thermocouple and the way it is mounted in the gas burner 4 are to be found in the Specification of co-pending patent application Ser. No. 417,282 filed Nov. 19, 1973.

Referring now to FIG. 1, it will be appreciated that certain of the components described above perform well-known functions. Valve 9, as will be made clear later, acts as a service tap, gas cock and a flame failure valve. Diaphragm 28 in conjunction with valve 40 acts as a gas pressure governor. Spring 37 in conjunction with valve 39 acts as a low gas pressure cut-off. Phial and bellows unit 84, 85 constitutes a water temperature controller whilst high level water temperature cut-out protection is provided by phial and bellows unit 81, 82.

FIG. 1 shows the control unit connected to a gas supply main, and the unit being in its "OFF" position. The flame failure valve 9 is closed as is the low pressure valve 39 and the main burner valve 57.

Figure 2:
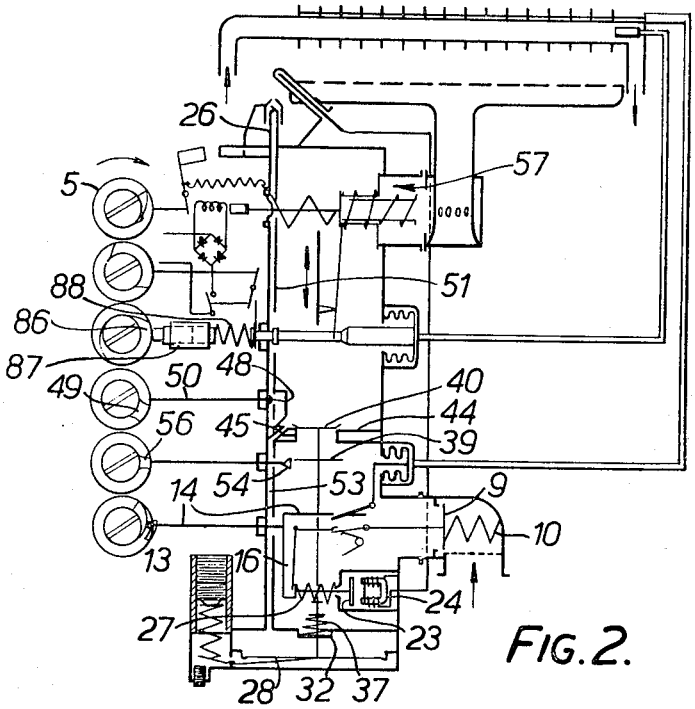

To bring the water heater into use, a user commences to rotate control knob 5 in a clockwise direction. Cam 13 acting through push-rods 12 and 14 opens valve 9 and moves armature 23 towards electromagnet 24. This allows gas to flow into the lower (as seen in FIG. 1) part of casing 6, cam 56 opens valve 54 and allows gas to pass through passageway 53 thus exposing the upper face of diaphragm 28 to gas pressure. That diaphragm 28 flexes downwardly (as seen in the drawing) against spring 37 and moves the low pressure valve 39 away from its seating and moves valve 40 on to its seating. In addition, pilot burner valve 48 is allowed to open by cam 49. This state in the sequence of operations is shown in FIG. 2. Gas passes to the pilot burner 26 via passage 45 which is upstream of valve 40 and conduit 51. Gas that by-passes the now closed valve 40 via passageways 53 and 52 cannot reach the main burner 4 because the main burner valve 57 is closed. Furthermore, if the user now releases the knob 5, spring 88 acting through adjuster 87 on to cam 86 will produce anticlockwise rotation of the knob 5 and its cams and the unit reverts to the position shown in FIG. 1, and all valves shut. At the stage shown in FIG. 2, the locking mechanism has not come into operation and spring 27 maintains a clockwise bias on lever 16.

Figure 3:
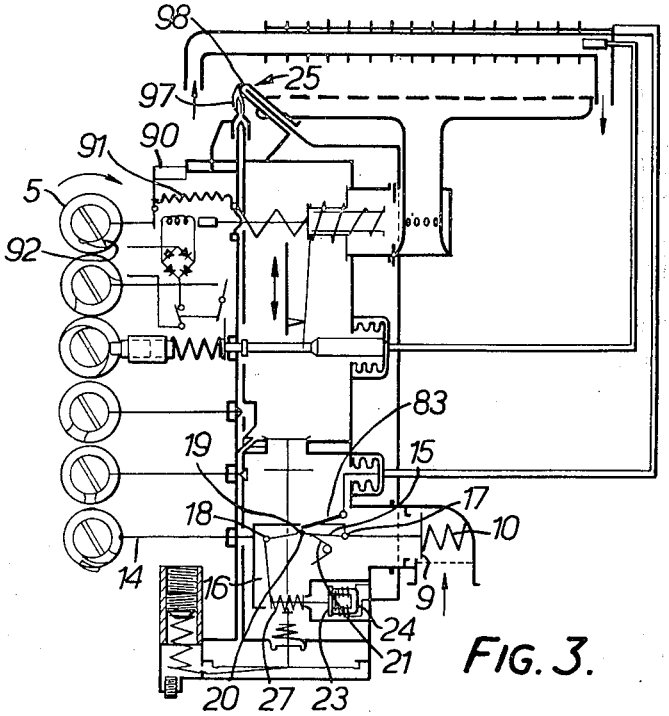

As knob 5 is rotated to produce the sequence of events described in the preceding paragraph, spring 91 is gradually tensioned until, and as shown in FIG. 3, the hammer 90 is released from the influence of cam 92 and strikes the piezo-electric crystal. The e.m.f. so generated produces a spark between electrode 97 and the tip 98 of the thermocouple housing 25 and this spark ignites the gas issuing from the pilot burner. The pilot burner flame heats the thermocouple 25 and the e.m.f. resulting therefrom energises electromagnet 24 to hold armature 23 against spring 27. Spring 21 pivots lever 15 to a position in which the point of contact between the recessed surface 19 of lever 16 and the rounded end 20 of lever 15 moves over a line joining pivot points 17 and 18 — the dead centre position — and the locking mechanism becomes effective to prevent spring 10 closing valve 9 if the control knob is released because the electromagnet 24 is energised. This state is shown in FIG. 3 and it will be seen that lever 83 is now in contact with lever 16 at a position such that excess travel of the point of contact beyond the dead centre position is prevented.

If, for some reason, electromagnet 24 is not energised, spring 27 will rotate lever 16 clockwise preventing the over-centre point being maintained.

Figure 4:
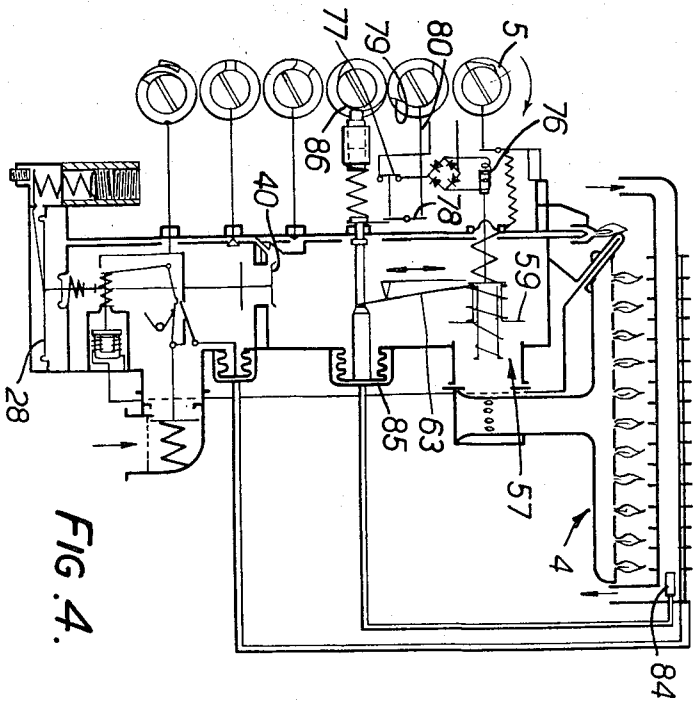

Further rotation of control knob 5 allows, through cam 79, rod 80 and lever 78, closure of the microswitch 77, energisation of electromagnet 76 and movement of the main gas valve 57. Disc 59 lifts away from its seating and gas flows via passageways 52 and 53 to the main burner 4 where it is ignited by the pilot burner flame. The position of the tubular portion 61 is shown in FIG. 10, in not the "at rest" position. The latter position of portion 61 is with end wall 68 in contact with flange 62 and slot 69 closed by the tubular extension 60. Thus, although connecting rod 70 is actually joined to end wall 68 and hence to tubular portion 61, spring 66 ensures that the main valve 58 follows the movement of the tubular portion 61. This state is shown in FIG. 4. As gas flows to the main burner 4, the gas pressure acting on diaphragm 28 drops somewhat and valve 40 opens. The diaphragm 28 acting in conjunction with valve 40 effects a pressure governing of the gas supply to the main burner.

Figure 5:
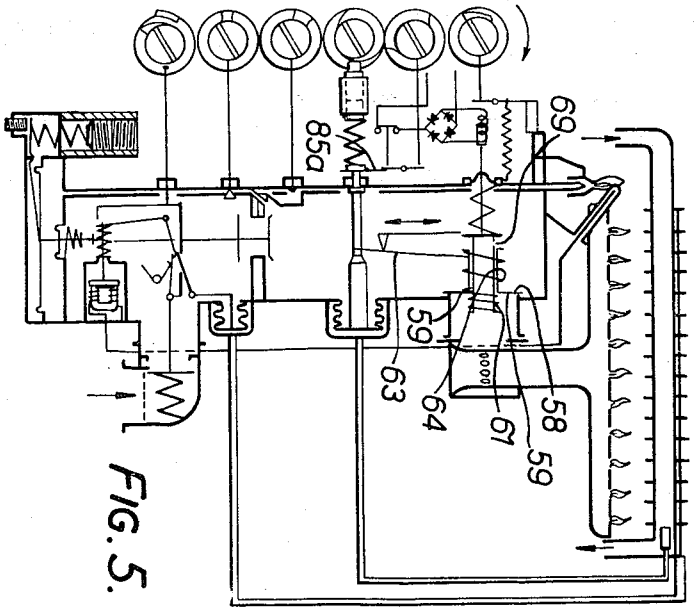
Figure 6:
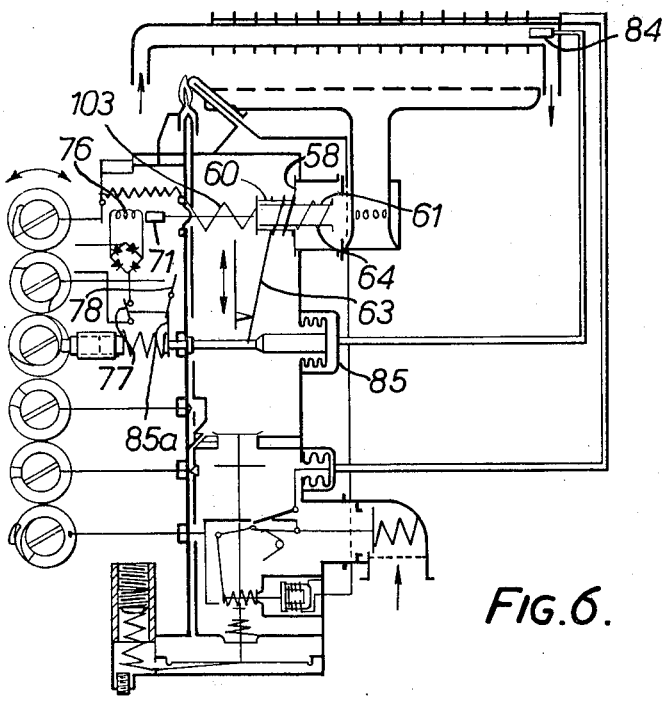

When the control system reaches the state shown in FIG. 4, sufficient rotation of the knob 5 necessary to bring the heater into operation has taken place. Further rotation then sets phial and bellows unit 84, 85 to a particular temperature through the medium of cam 86. As that preset temperature is approached, bellows unit 85 acting through lever 63 moves main valve 58 towards its closed position thereby modulating the gas flow to the burner in accordance with water temperature. When the preset temperature is reached, disc 59 is fully seated. During this movement of the main valve 58, tubular portion 61 remains stationary so that slot 69 becomes exposed to an increasing extent as disc 59 moves towards its seating. FIG. 5 shows that position as does FIG. 10.

If now the temperature to which phial 84 is exposed continues to rise further pivotal movement of lever 63 occurs but this is accommodated by compression of spring 64 and there is no further movement of the main valve 58. However, member 85*a* then actuates lever 78 which in turn operates the microswitch 77 to de-energise electromagnet 76 and armature 71 acting under spring 105 returns portion 61 to the position shown in FIG. 6 in which slot 69 is closed by the tubular extension 60. Gas now ceases to flow to the main burner 4. If now the water temperature drops, the sequence of events just described is followed in reverse.

Figure 7:
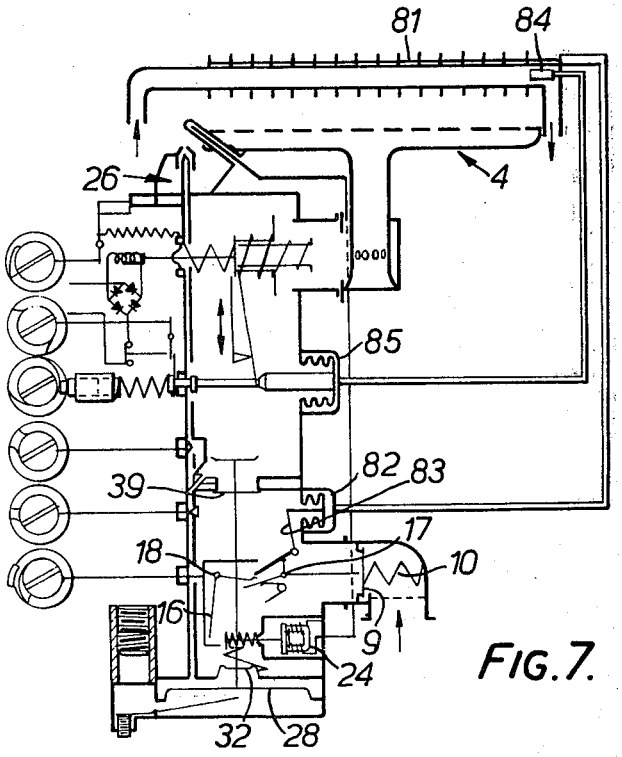
Figure 8:
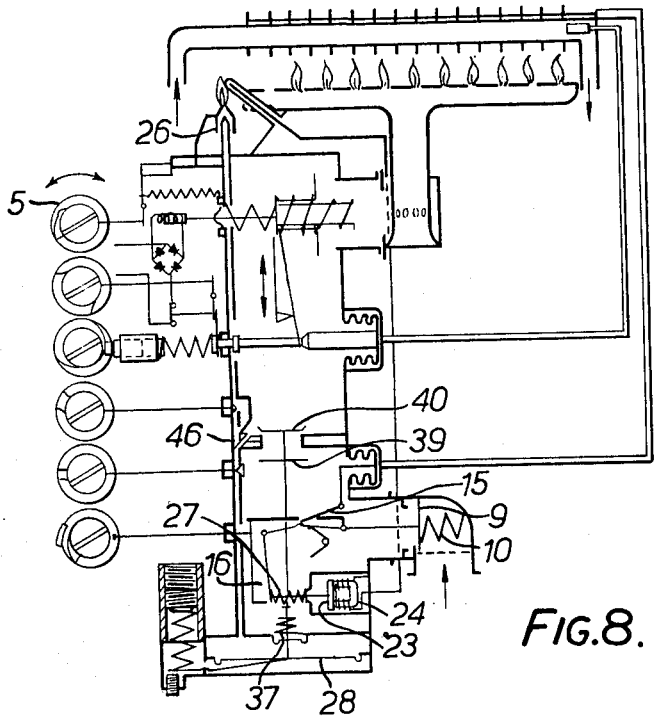

However, if the temperature continues to rise phial and bellows unit 81, 82 responds when a predetermined temperature is reached and the bellows unit 82 causes anti-clockwise movement of lever 83 which forces the point of contact mentioned above over the centre line joining pivot points 17 and 18 thereby allowing spring 10 to close valve 9 so cutting off gas supply completely to both main and pilot burners 4, 26. Closure of valve 9 removes gas pressure from diaphragms 28 and 32 so valve 39 shuts. After a few seconds delay electromagnet 24 is de-energised in the absence of a flame at the pilot burner. This stage is shown in FIG. 7 which shwos also a failure in the capillary interconnecting phial 84 and bellows unit 85 thus causing loss of regulation of gas flow to the main burner and consequent overheating of water. The heater can now be brought in operation again only by resetting the control knob to its start position and following the sequence of rotation of the knob described above. If the fault producing overheating has not been dealt with the sequence of events just described will take place and once more the heater will be rendered inoperative.

The control includes a lock-out device preventing re-ignition whilst the electromagnet 24 is still energised creating the condition in which the gas valve 9 is fully opened. When the heater is turned off by turning knob 5 to "OFF", an abutment on the back of the knob co-operates with rod 14 in such manner that the knob cannot be turned from the OFF into the ON position while the electromagnet is still responding to heat of the pilot burner and the locking mechanism holds rod 14 in that position. When the temperature of heat response element 81 falls, rod 14 is released and the projection on the end falls into a key slot behind the abutment allowing the knob to be turned to the ON position.

If, during operation of the heater, a considerable drop in gas pressure occurs, as might happen for example if an external gas cock were operated to terminate the gas supply. In this event, diaphragm 28 responds by moving valve 40 to its fully open position in an attempt to maintain the gas supply but this action is ineffective and spring 37 acts quickly to close low pressure valve 39. Closure of valve 39 terminates the supply of gas via passageway 45 to the pilot burner 26. The absence of a flame at the pilot burner results in de-energisation of electromagnet 24 and armature 23 releases under the action of spring 27 and pushes lever 16 out of the locked position and spring 10 is able to close valve 9 thereby cutting off the supply of gas to the main burner. When the gas pressure is restored, the valve 9 remains closed until the proper start-up sequence has been followed.

The modulation control exercised by the main valve 58 has been described above. Variation of the movement of the main valve 58 is effected by changing the position of the pivot point 65 of the lever 63. This enables the modulation factor (the rate of change of gas rate with boiler temperature) to be kept constant for the range of gases of different characteristics and boiler outputs for which the boiler is designed. In addition, adjustment of the position of the housing 72 by the screw adjuster 73 enables the position of the tubular portion 61 relative to the main valve 58 to be modified to determine the effective size of the slot 69 when the components are in the positions shown in FIG. 10. This provides a control of the maximum rate of flow of gas to the main burner through the tubular portion 61. This enables the by-pass rate to be adjusted independently of the rating of the heater and of adjustment of the pivot position.

The loading of diaphragm 28 by spring 33 is adjustable by the screw adjuster 36. Interposed between the adjuster 36 and spring 33 is a bearing washer (not shown) which prevents the spring being twisted as the screw adjuster is turned to effect adjustment. Conveniently, the end wall 29 may form a removable cover for the diaphragm chamber and the pivot point is, as described above, formed in the lid.

Disconnection of the casing 6 from the elbow 8 can be readily effected when necessary, the existence of spring 10 ensuring that valve 9 remains closed. Push-rod 12 is withdrawn from the mouth of the elbow 8 when the casing is disconnected.

It will be appreciated that the above-described embodiment provides, in a single unit, all the control facilities normally required and that, because of the single control knob, it is relatively easy for a user to follow the correct sequence of operations when it is desired to bring the gas-fired appliance into use. Moreover, the single unit also includes the pilot burner and thermocouple head.

I claim:

1. A control system for a gaseous fuel fired appliance, said system comprising a gaseous fuel flow control means including a first flow control member for controlling fuel flow from a fuel inlet to a fuel outlet, a passage between said fuel inlet and outlet by-passing said first flow control member, a second flow control member for controlling fuel flow along said passage, a movable member, means for actuating said movable member, a linkage interconnecting the movable member and the first flow control member for transmitting to the latter movement of the movable member, means for varying the ratio of movement of the movable member to movement of the first flow control member, means for moving both the first flow control member and the second flow control member as a unit between an "off" position in which fuel flow from said inlet to said outlet and along said passage is prevented and an "on" position in which said fuel flow is permitted and from which on position further movement of the first flow control member to regulate the flow of fuel from the inlet to the outlet is effected by the movable member, and further means for adjusting the effective cross-sectional area of the passage to control the maximum rate of fuel along the passage and thus from said inlet to said outlet when said first flow control member is closed.

2. A control system as claimed in claim 1 in which the passage passes through the first flow control member and in which the further means is mounted upon the latter member.

3. A control system as claimed in claim 2 in which the first flow control member comprises a valve member and a co-operating valve member seating, fuel flow from the inlet to the outlet via the first flow control member being stopped when the valve member seats on the seating.

4. A control system as claimed in claim 3 in which the linkage comprises a pivotally-mounted lever interconnecting the movable member and the first flow control member, means being provided for moving the pivot point of the lever along part at least of the length of the latter.

5. A control system as claimed in claim 4 in which the lever is resiliently connected to the valve member in such manner that pivotal movement of the lever occurring after the valve member seats on the seating takes place against the resilient connection.

6. A control system as claimed in claim 3 in which the valve member includes a tubular extension forming the passageway, and in which the further means comprises a tube movable axially relatively to the tubular extension for varying the rate of flow of fuel through the passage.

7. A control system as claimed in claim 6 in which the tube is open at one end and closed at the other and has, adjacent the closed end a slot that extends round part of the periphery of the tube, the slot being obturated to a greater or lesser extent by axial movement of the tube relatively to the tubular extension.

8. A control system as claimed in claim 7 in which the arrangement for moving the first flow control member comprises an electromagnet whose armature is operatively connected to the closed end of the tube, the arrangement being such that movement of the first flow control member involves movement of the second flow control member also.

9. A control system as claimed in claim 1 in which said means for actuating said movable member comprises a thermally responsive device.

10. A control system as claimed in claim 1 in which the fuel flow control means also includes a manually-operable control for controlling the means for moving the first and the second flow control members.

11. A control system as claimed in claim 10 in which the manually-operable control also controls the setting of the thermally responsive device.

12. A control system as claimed in claim 11 in which the manually-operable control also operates a valve for controlling the flow of fuel to a pilot burner and an ignitor for igniting fuel issuing from the pilot burner.

13.. A control system as claimed in claim 12 in which the ignitor includes a high voltage generator, a pilot burner having a body incorporating a spark electrode, the electrode being electrically connected to the high voltage output of the generator.

14. A control system as claimed in claim 13 in which the body is at least partly of electrically-conductive material and in which the spark electrode is part of or is mounted upon that part.

15. A control system as claimed in claim 10 in which the manually operable control includes resilient biassing means for returning the control to an initial starting point on release after a predetermined movement from that initial position.

16. A control system as claimed in claim 10 in which the manually operable control comprises a lock-out device for preventing the said manually operable control from being re-operated for a predetermined period after having been returned to its initial starting point.

17. A control system as claimed in claim 1 in which the manually operable control comprises a lock-out device for preventing the said manually operable control from being re-operated for a predetermined period after having been returned to its initial starting point.

* * * * *